US011161025B2

(12) United States Patent
Hill

(10) Patent No.: US 11,161,025 B2
(45) Date of Patent: Nov. 2, 2021

(54) STANCE TRAINING DEVICE FOR SLED PUSHING

(71) Applicant: Adam Creed Hill, Valrico, FL (US)

(72) Inventor: Adam Creed Hill, Valrico, FL (US)

( * ) Notice: Subject to any disclaimer, the term of this patent is extended or adjusted under 35 U.S.C. 154(b) by 45 days.

(21) Appl. No.: 16/730,063

(22) Filed: Dec. 30, 2019

(65) Prior Publication Data

US 2020/0254321 A1 Aug. 13, 2020

Related U.S. Application Data

(60) Provisional application No. 62/803,807, filed on Feb. 11, 2019.

(51) Int. Cl.
*A63B 69/34* (2006.01)

(52) U.S. Cl.
CPC ..... *A63B 69/345* (2013.01); *A63B 2243/007* (2013.01)

(58) Field of Classification Search
CPC ..... A63B 69/345; A47G 27/0218; A47G 27/025; A47G 27/0293
USPC ..... 473/445
See application file for complete search history.

(56) References Cited

U.S. PATENT DOCUMENTS

| | | | | |
|---|---|---|---|---|
| 4,067,571 | A * | 1/1978 | Rogers | A63B 69/345 473/445 |
| 9,498,693 | B1 * | 11/2016 | Kraus | A63B 69/345 |
| 9,737,748 | B1 * | 8/2017 | Chapman | A63B 21/0442 |
| 2010/0025967 | A1 * | 2/2010 | Flaig | A63C 5/128 280/612 |
| 2012/0184385 | A1 * | 7/2012 | Davis | A63J 1/02 472/77 |
| 2014/0315665 | A1 * | 10/2014 | Hall | A63B 69/345 473/445 |

OTHER PUBLICATIONS

Fisher Athletic 2018 Football Catalog, vol. FB616, p. 22-24 and 27, published Jun. 26, 2017, available online at issuu.com/fisherathletic/docs/final2018footballforweb/35 (Year: 2017).*

* cited by examiner

*Primary Examiner* — Laura Davison
(74) *Attorney, Agent, or Firm* — Nicholas Pfeifer; Smith & Hopen, P.A.

(57) ABSTRACT

A training device that is easily and temporarily attachable to any existing sled training device. The training device includes a flexible, elongated plank that resides between an athlete's legs and helps train the athlete to maintain a proper stance width while blocking or pushing a sled. An embodiment includes a magnet secured to the plank at a first end of the plank. The magnet engages the sled and is detached from the sled when the athlete pushes the sled with an improperly narrow stance width. As a result, the athlete experiences a tactile and visual aid to distinguish between proper and improper stance width while pushing a sled.

14 Claims, 12 Drawing Sheets

STANCE TRAINING DEVICE FOR SLED PUSHING

CROSS-REFERENCE TO RELATED APPLICATIONS

This nonprovisional application is a continuation of and claims priority to provisional application No. 62/803,807, entitled "STANCE TRAINING DEVICE FOR SLED PUSHING," filed Feb. 11, 2019 by the same inventor.

BACKGROUND OF THE INVENTION

1. Field of the Invention

This invention relates, generally, to training equipment. More specifically, it relates to a device designed to train athletes, such as football players, on the proper stance when pushing a sled or blocking an opponent.

2. Brief Description of the Prior Art

Football players have historically relied on a device commonly referred to as a football blocking sled in order to improve their blocking skills. These sleds are heavily weighted and typically include a sled base with a pad/blocking dummy extending generally in a vertical direction from the sled base. When in use, a football player lines up in front of the blocking dummy in a starting position, explosively engages the dummy, and pushes the sled back away from the player's starting position. The blocking dummy allows a player to practice his hand technique in engaging the dummy while the weighted sled portion forces the player to drive the weighted sled with his lower body.

A problem often encountered during these drills is the player pushing the sled with a narrow stance. Untrained athletes often revert their stance to a narrow width when pushing a sled because it is easier to push a heavy, stable object with a narrow stance. A narrow stance, however, is particularly problematic when attempting to block an opponent in a football game. The opponent will often employ techniques to throw a blocker off-balance in an attempt to bypass said blocker. If the blocker's feet are not properly spread in a blocking stance, the blocker lacks a certain preferred amount of balance and stability allowing the opponent to easily succeed in bypassing the blocker. Thus, it is important to teach and train athletes, such as football players, to block with a wider stance with respect to the frontal/lateral plane of their bodies. Accordingly, what is needed is a device and method for training athletes to maintain a wide stance while pushing a sled. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for device and method for training athletes to maintain a wide stance while pushing a sled is now met by a new, useful, and nonobvious invention.

The novel structure includes a plank having a length extending between a first end and a second end and a width extending between a first lateral side and a second lateral side. In an embodiment, the length is between six and nine feet. In an embodiment, the width of the plank is between six and twenty-four inches.

An attachment component is secured to the plank proximate the first end of the plank. The attachment component is configured to engage the sled and the plank to temporarily secure the sled to the plank. The attachment component is adapted to disengage the plank from the sled upon being subject to a tension force exceeding a predetermined threshold force. The plank thereby provides a tactile and visual indication of an improperly narrow stance when an athlete steps on the plank while pushing the sled and the plank resultingly disconnects from the sled.

In an embodiment, the attachment component includes a first magnet configured to magnetically engage a magnetically-responsive material on the sled. In an embodiment, the first magnet is secured between a top surface and a bottom surface of the plank. An embodiment includes a magnet housing proximate the first end of the plank. The magnet housing is configured to open and close for securing the first magnet within the magnet housing. An embodiment further includes a magnet recess proximate the first end of the plank. The magnet recess is configured to house at least a portion of the first magnet residing internally with respect to the top surface or the bottom surface.

An embodiment includes a second magnet secured to the plank proximate the second end of the plank. The plank can be rolled up and secured in position via the first and second magnets. In addition, multiple planks can be attached to each other using the first and second magnets.

In an embodiment, the plank weighs between ten and twenty-five pounds. In an embodiment, the first magnet has a magnetic strength equivalent to a force between ninety-five and two hundred and twenty-five pounds.

In an embodiment, at least the first end of the plank is comprised of a flexible material.

An embodiment includes a plurality of planks. Each plank includes a length extending between a first end and a second end and a width extending between a first lateral side and a second lateral side. In an embodiment, the width of each plank being between six and twenty-four inches. A first magnet is secured proximate the first end of at least a first plank in the plurality of planks. Thus, the first plank can be temporarily secured to a sled via the first magnet. An attachment component is configured to connect longitudinally adjacent planks to each other, such that the plurality of planks act as a single plank. Moreover, the first magnet is adapted to disengage the first plank from the sled upon when the plurality of planks are subjected to a tension force exceeding a predetermined threshold force. The plurality of planks thereby provides a tactile and visual indication of an improperly narrow stance when an athlete steps on one of the plurality of planks while pushing the sled and the first plank resultingly disconnects from the sled.

In an embodiment, the combined weight of the plurality of planks is between ten and twenty-five pounds. In an embodiment, the first magnet has a magnetic strength equivalent to a force between ninety-five and two hundred and twenty-five pounds.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

Figure 1:
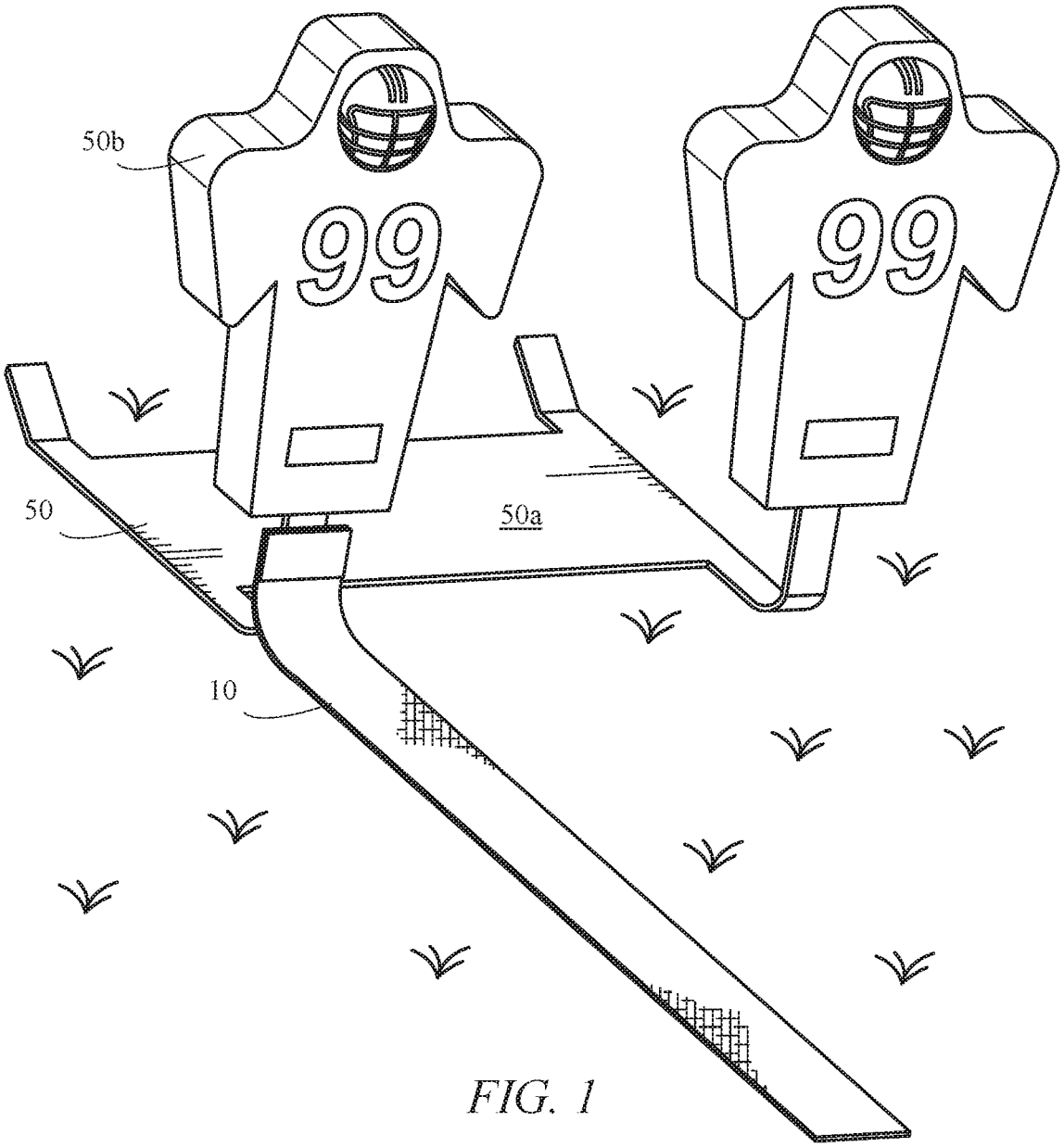
FIG. 1 is an embodiment of the present invention attached to a blocking sled.
Figure 2:
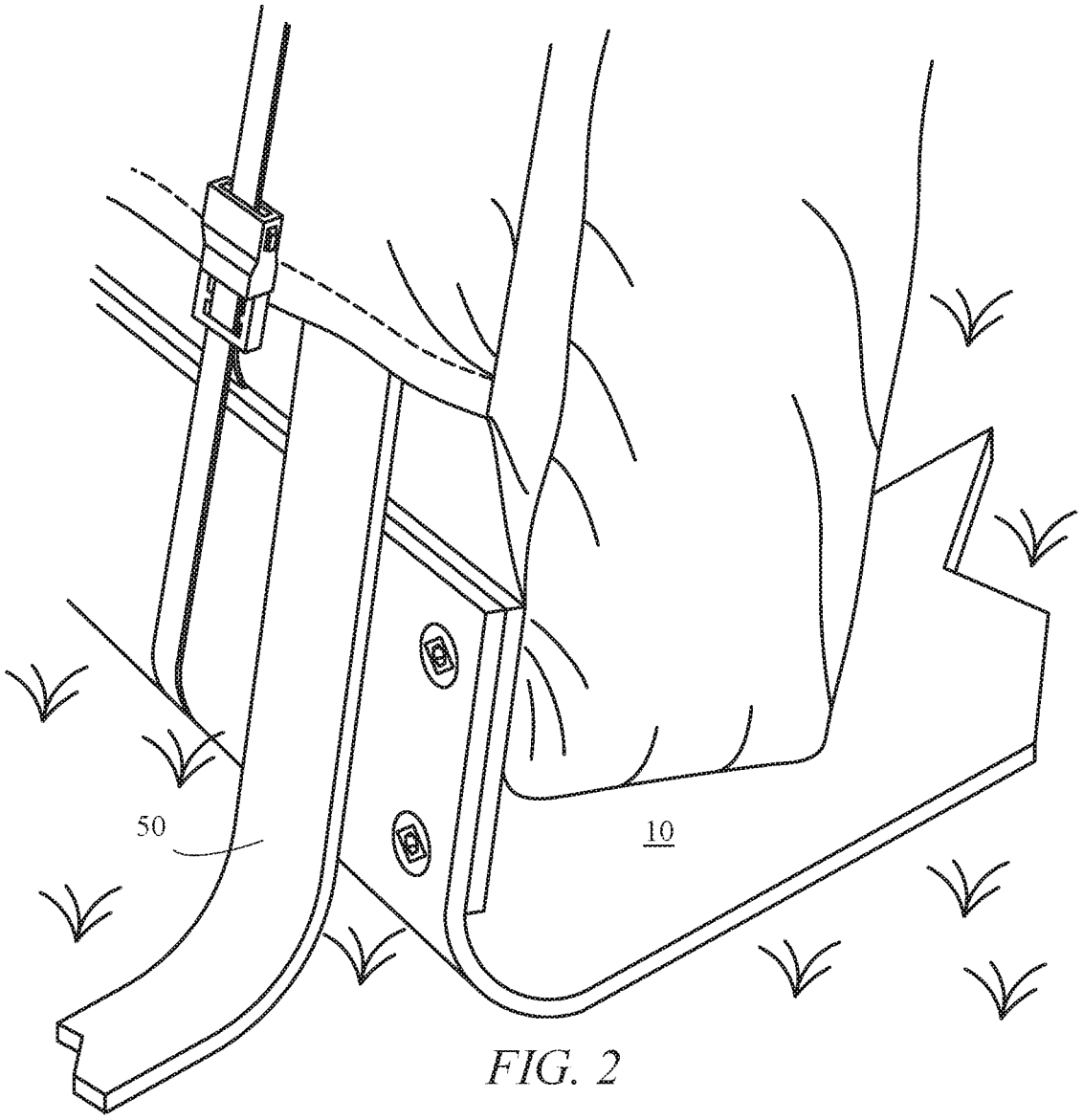
FIG. 2 is a close up view of an embodiment of the present invention attached to a blocking sled.
Figure 4:
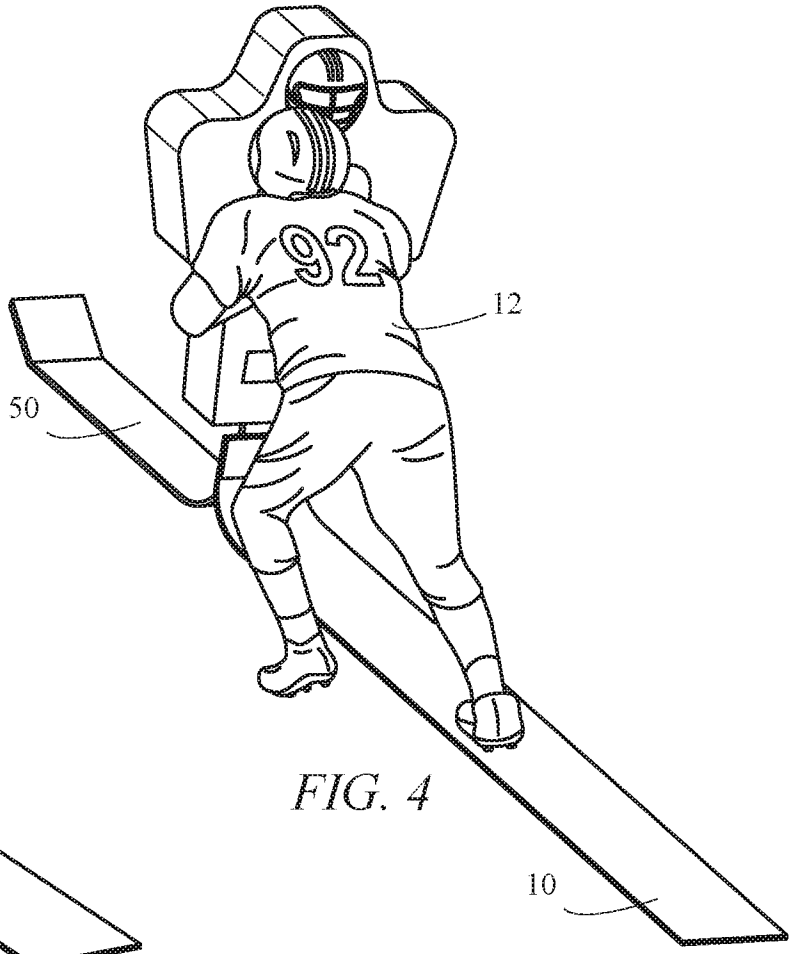
FIG. 4 depicts an athlete engaging the sled with an improper blocking stance.
Figure 3:
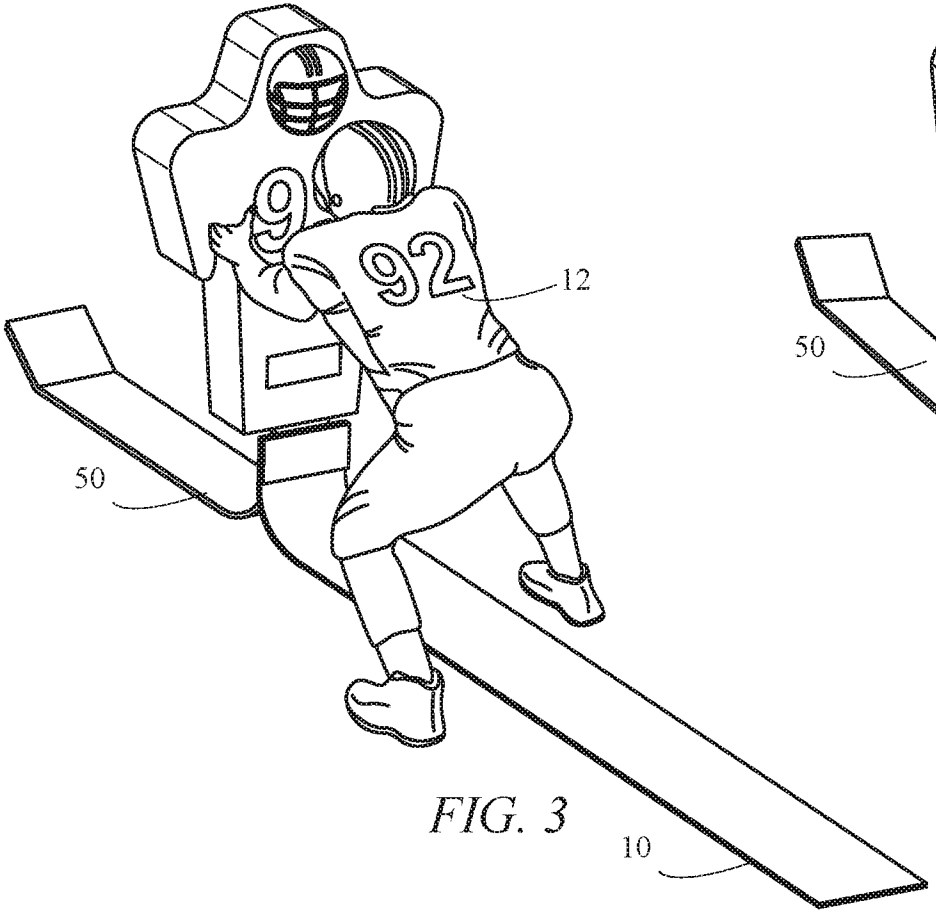
FIG. 3 depicts an athlete engaging the sled with a proper blocking stance.

The present invention includes a training device designed to teach athletes, such as football players, to drive a training sled with a wider stance. The training device is particularly useful for teaching athletes, such as football player 12, to block an opponent with a proper stance width, which can be seen in FIG. 3. The training device is temporarily attachable to nearly any existing sled device, such as a common football blocking sled 50 having sled base 50*a* and blocking pad 50*b*. The training device is also configured to easily detach from blocking sled 50 if athlete 12 steps on plank 10 while pushing sled 50, as shown in FIG. 4. The training device provides both a tactile and visual indication to the athlete as to whether the athlete has executed the blocking drill with a proper stance width.

As shown in FIG. 1-9, an embodiment of the present invention includes an elongated relatively flat and flexible plank 10. Plank 10 includes a length extending between proximal end 14 and distal end 16. In an embodiment, the length is between six and nine feet to accommodate athletes of various heights. Lateral sides 18 establish a width therebetween. In an embodiment, the width of plank 10 is between nine inches and twenty-four inches based on the athlete's size and, in turn, the athlete's preferred stance width, which is typically correlated to the athlete's height. In an embodiment, the width of plank 10 is between six inches and twelve inches. Top surface 20 and bottom surface 22 establish a thickness. In an embodiment, the thickness is between 0.25 inches and 0.75 inches.

Figure 19:
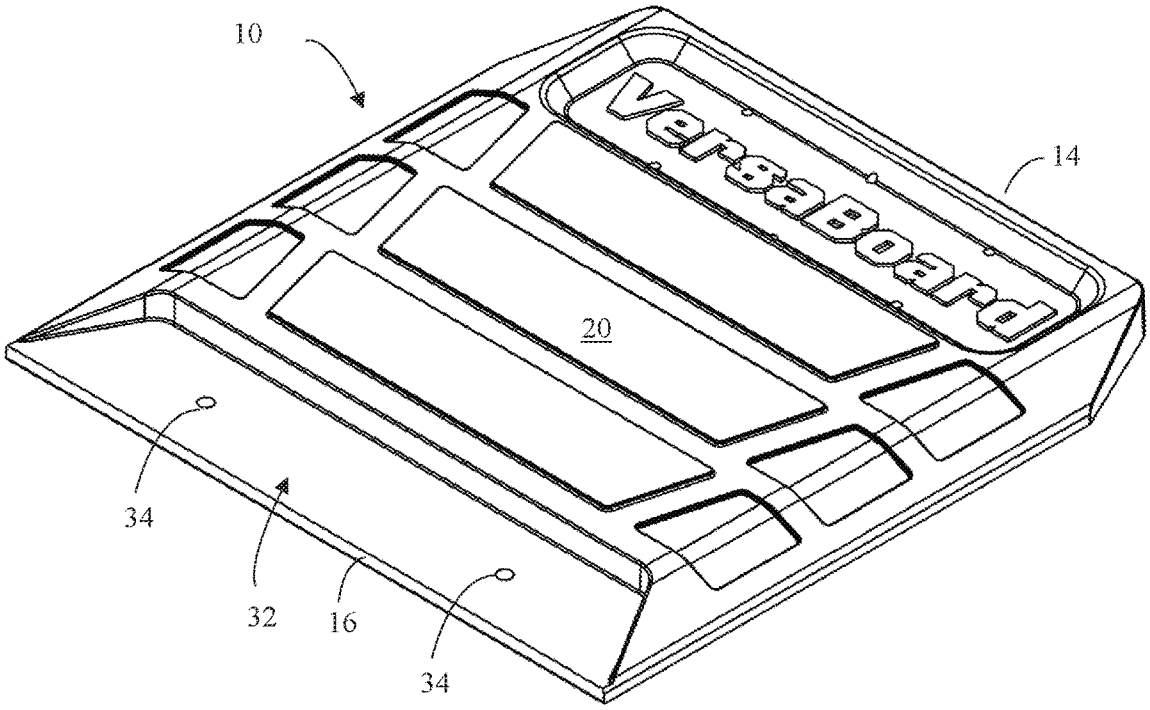
FIG. 19 is a perspective view of an embodiment of the present invention.
Figure 20:
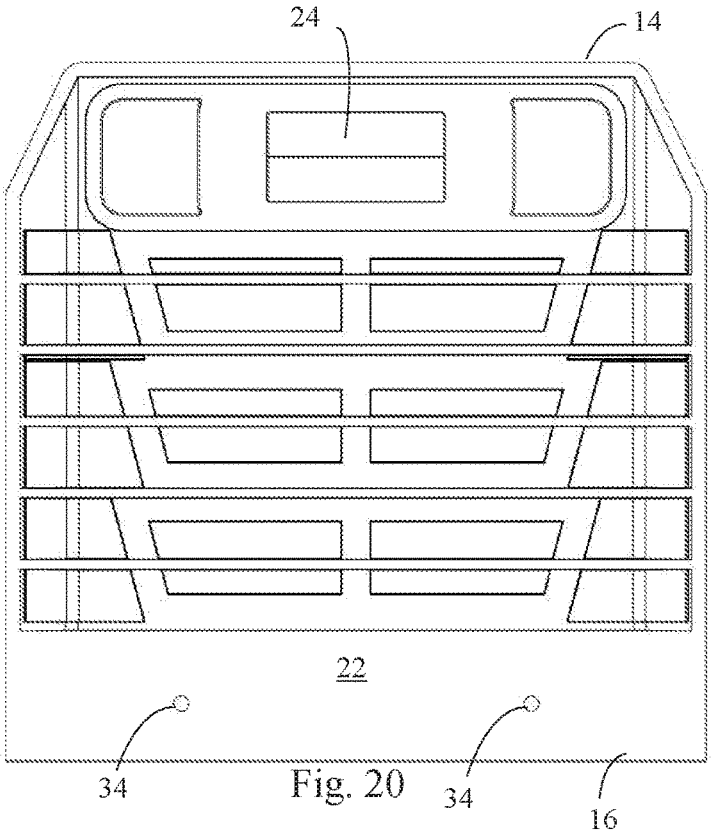
FIG. 20 is a bottom view of an embodiment of the present invention.
Figure 21:
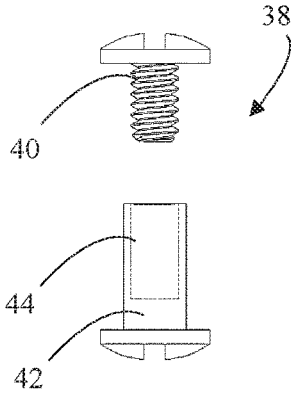
FIG. 21 is a plan view of an embodiment of an attachment component.

An embodiment may include other forms of plank interconnectors 28 and interconnector receipts 30 known to a person of ordinary skill in the art. For example, an embodiment may include secondary magnet(s) located at distal end 16 of plank 10 that are configured to magnetically engage magnets 24 secured to a secondary longitudinally aligned plank. Another embodiment, as depicted in FIGS. 19-21, includes interconnector receipts 30 in the form of fastener apertures 34 disposed through top and bottom surfaces 20, 22 near distal end 16 and near proximal end 14.

Magnetic fastener 24 allows plank 10 to easily detach from sled 50 when an athlete steps of plank 10 while executing a blocking/pushing drill with an incorrect stance width. In addition, magnetic fastener 24 allows for easy reattachment of plank 10 to the sled 50. The easy detachment of plank 10 from sled 50 is an important characteristic of the present invention to ensure that the athletes are not injured when the heavily weighted sled suddenly ceases movement because of an athlete inadvertently stepping on plank 10. If the plank was not designed to detach from the sled when stepped on, the sled would abruptly stop traveling and spring back into the athlete. The sled would become immovable and the athlete's body would be forced to absorb the impact force, which could significantly injure the athlete.

In an embodiment, magnet 24 has a magnetic strength in a range equivalent to 95 lbs to 225 lbs of pulling force. The strength of magnet 24 may vary depending on the intended user and/or the intended surface on which the sled is used. For example, artificial turf has a different coefficient of friction as compared to a dirt or muddy field. Thus, the magnet strength may be adjusted for planks that are intended to be used on turf fields verses planks that are intended to be used on natural surfaces. When various magnets are used, the combined strength of the magnets is a range equivalent to 95 lbs to 225 lbs of pulling force.

Figure 5:
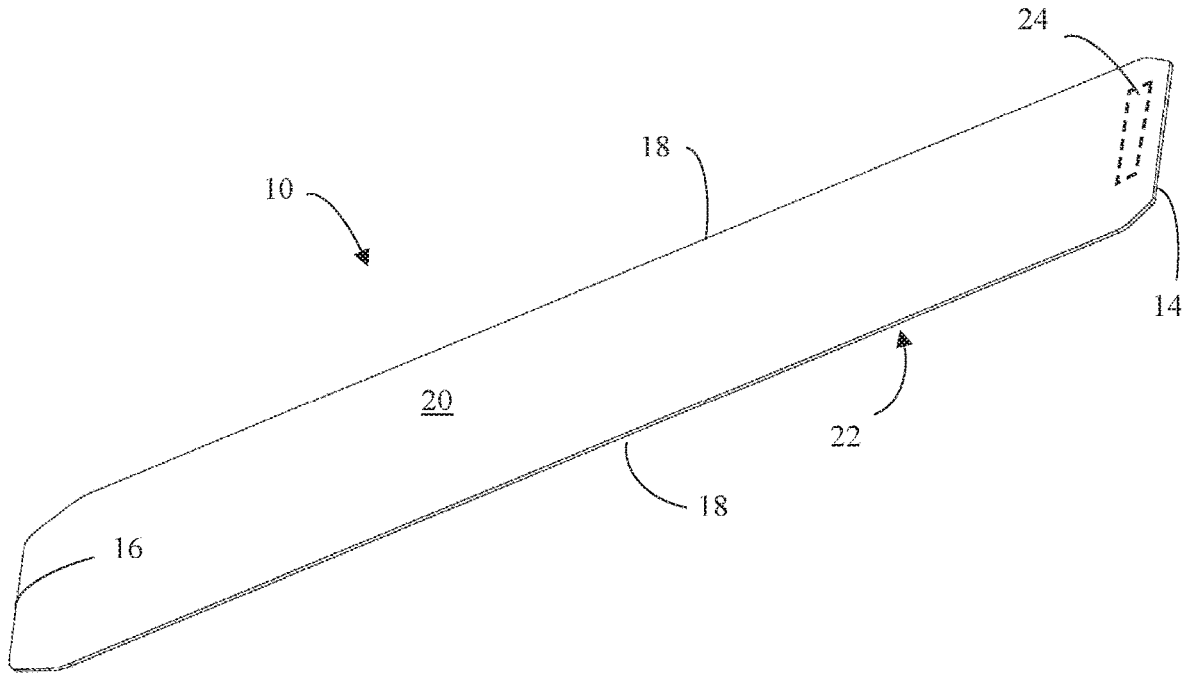
FIG. 5 is a perspective view of an embodiment of the present invention.
Figure 6:
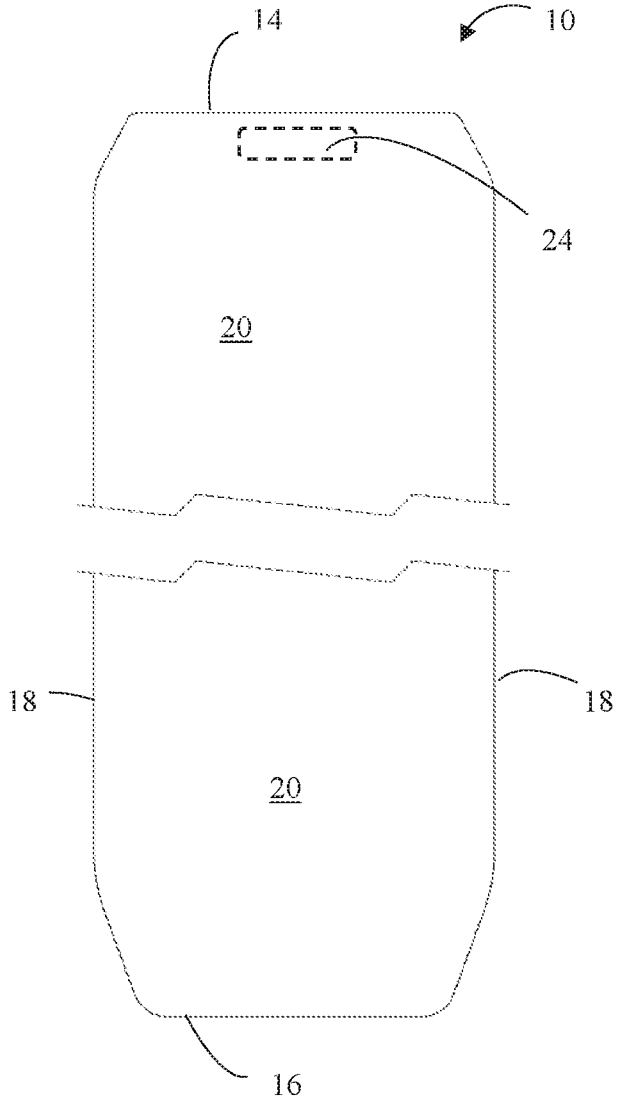
FIG. 6 is a top view of an embodiment of the present invention.
Figure 7:
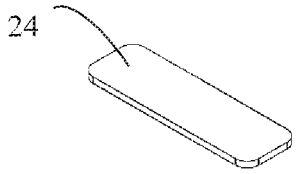
FIG. 7 is a perspective view of an embodiment of the magnet for use with an embodiment of the present invention.

Referring now to FIGS. 5-7, an embodiment of the present invention includes magnet 24 disposed between top and bottom surface 20, 22. In this embodiment magnet 24 is protected from the elements ensuring that it will last longer. However, an embodiment includes magnet 24 at least partially exposed from or flush with top surface 20 and/or bottom surface 22 of plank 10. An embodiment may also include magnet 24 simply secured to either top or bottom surfaces, 20, 22. Magnet 24 may be secured to top or bottom surfaces, 20, 22 via any attachment methods known to a person of ordinary skill in the art.

An embodiment includes a hollowed-out magnet receipt disposed in top or bottom surfaces 20, 22 of plank 10. The receipt is sized to receive the magnet and an adhesive disposed between the magnet and plank 10. Preferably the depth of the receipt is such that the bottom and/or top surface of the magnet is flush with the bottom and/or top surface of plank 10 when magnet 24 is adhered to plank 10.

In an embodiment, plank 10 includes a magnet housing configured to open and securely close, such that magnets of different strengths can be exchanged and secured within the magnetic housing. As a result, a single plank can be used for a wide range of athletes based on their size/age and/or the field on which the plank in intended to be used. This embodiment also allows for different magnets to be used based on the type of sled to which the device is attached. However, an embodiment having an embedded magnet is beneficial in that it will decrease the manufacturing expenses.

Figure 8:
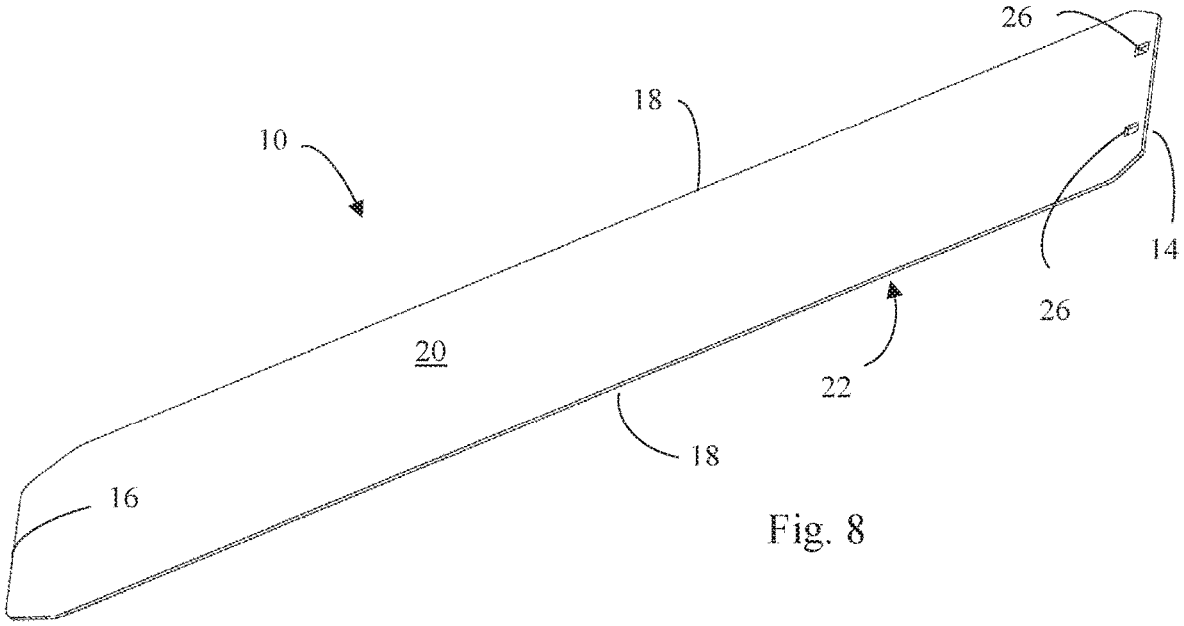
FIG. 8 is a perspective view of an embodiment of the present invention.
Figure 9:
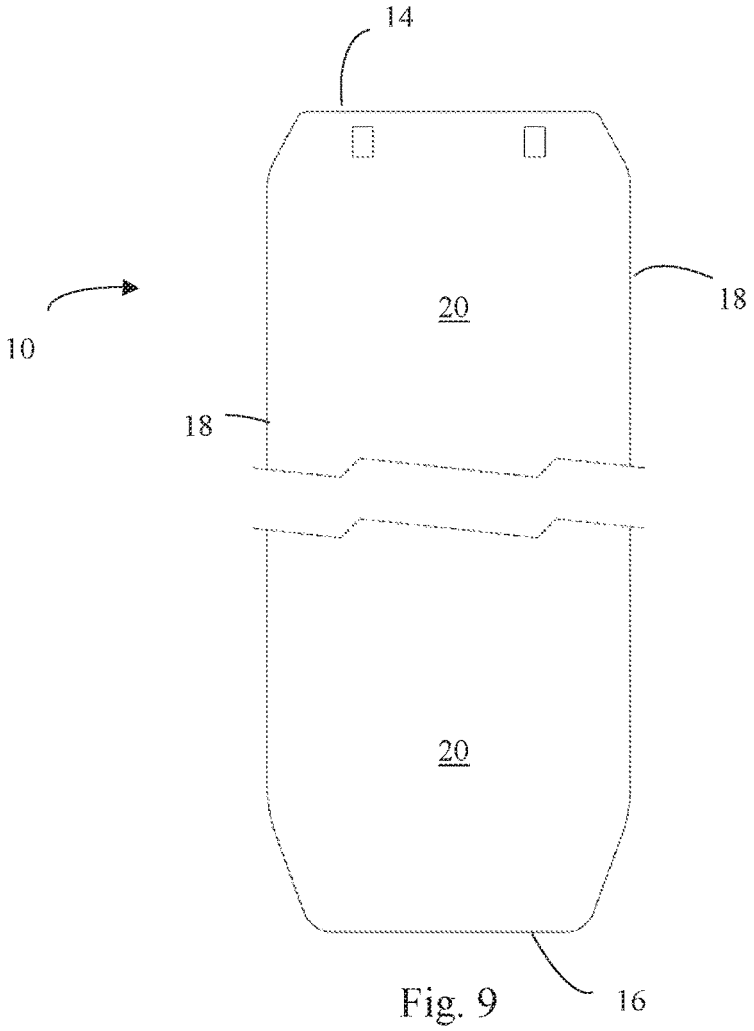
FIG. 9 is a top view of an embodiment of the present invention.
Figure 10:
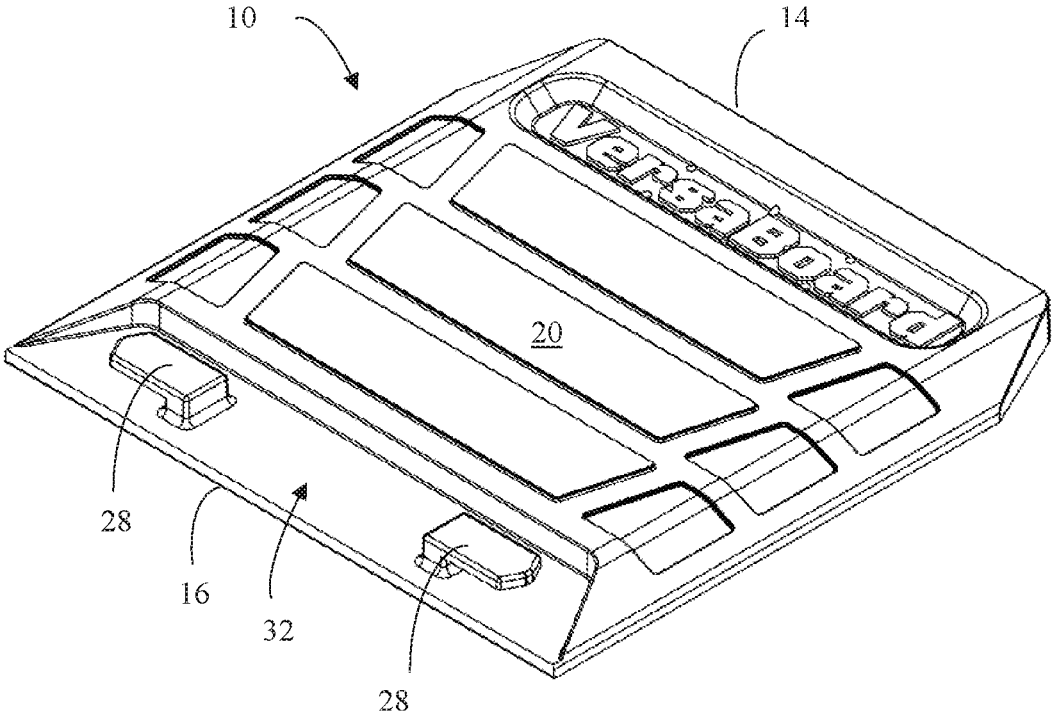
FIG. 10 is a perspective view of an embodiment of the present invention.
Figure 11:
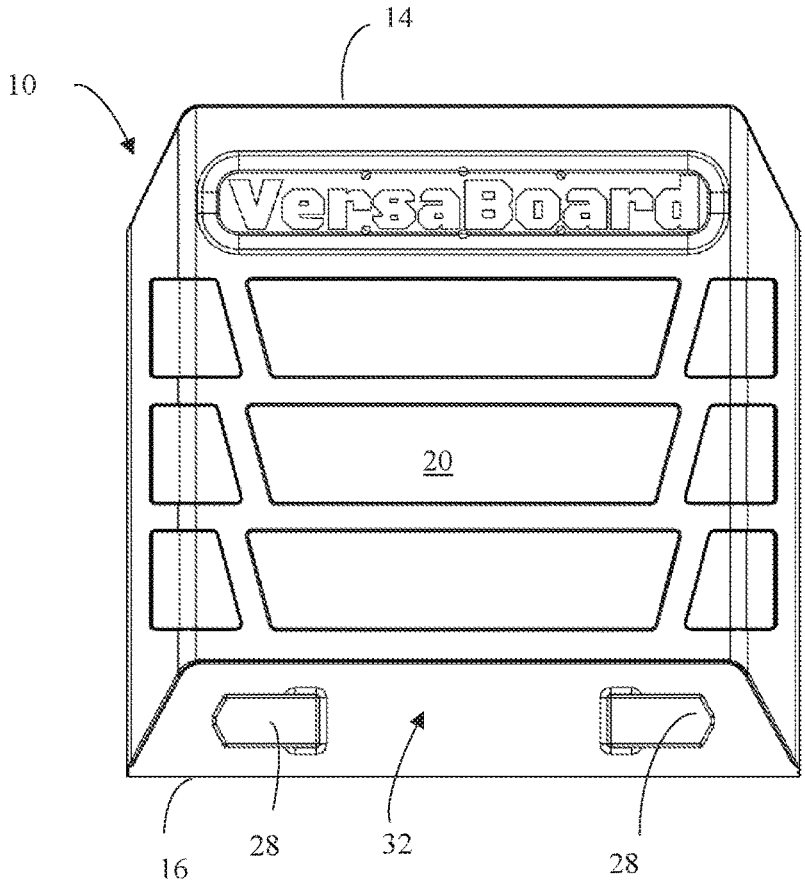
FIG. 11 is a top view of an embodiment of the present invention.
Figure 12:
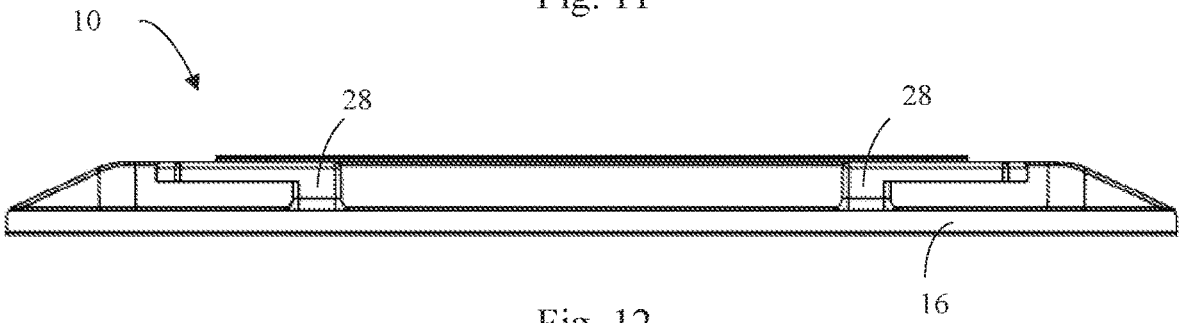
FIG. 12 is a plan view of an embodiment of the present invention from a distal end of the plank.
Figure 13:
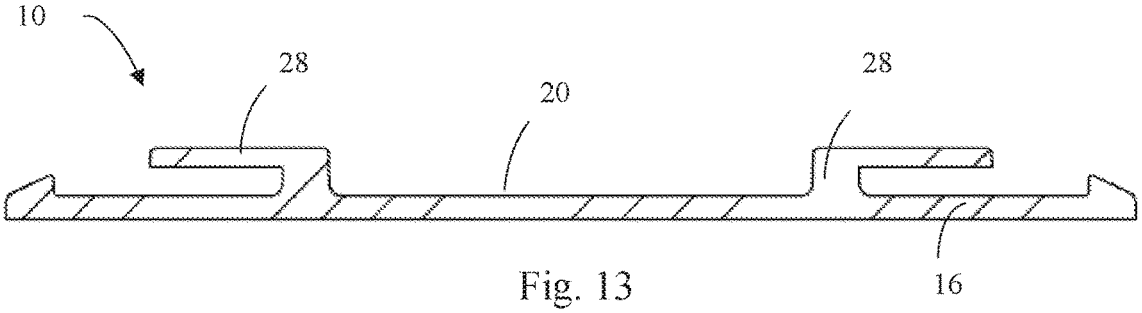
FIG. 13 is a cross-sectional view of FIG. 12.
Figure 14:
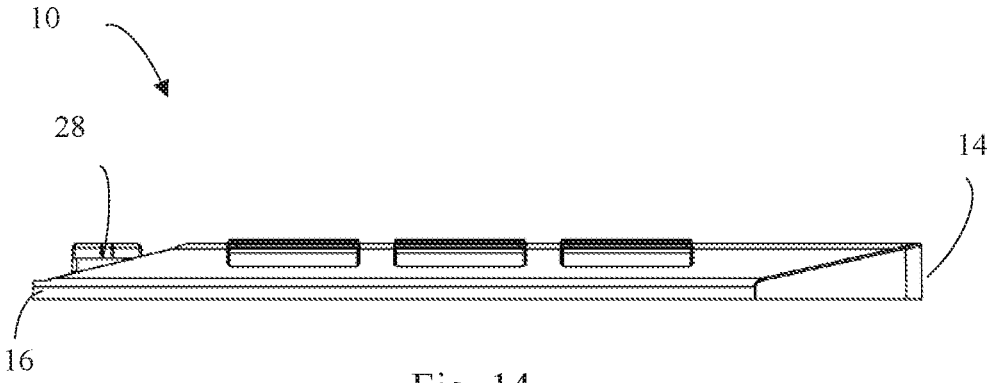
FIG. 14 is a side view of an embodiment of the present invention.
Figure 15:
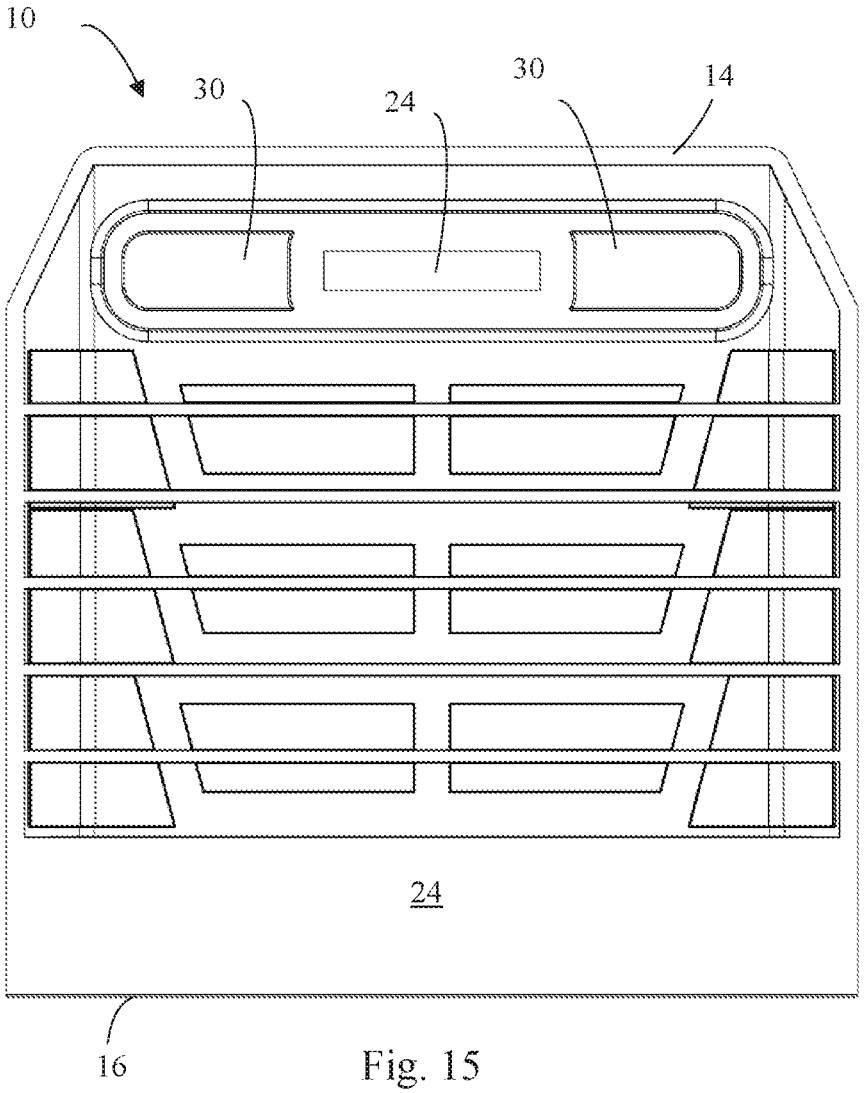
FIG. 15 is a bottom view of an embodiment of the present invention.
Figure 16:
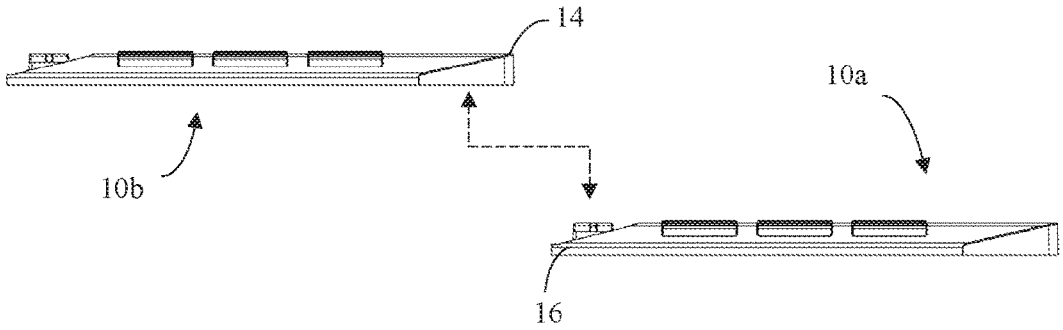
FIG. 16 is a side view of an embodiment of the present invention showing how two longitudinally adjacent planks engage each other.
Figure 17:
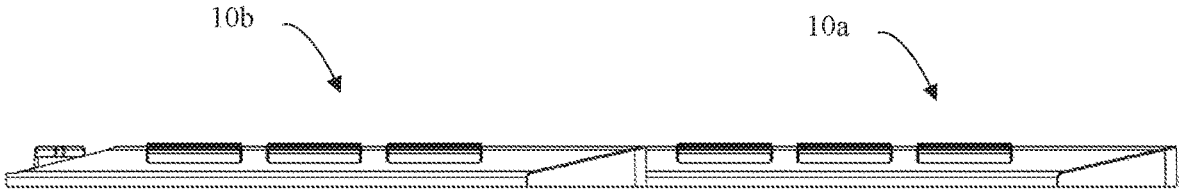
FIG. 17 is a side view of an embodiment of the present invention showing two longitudinally adjacent planks engaged to each other.
Figure 18:
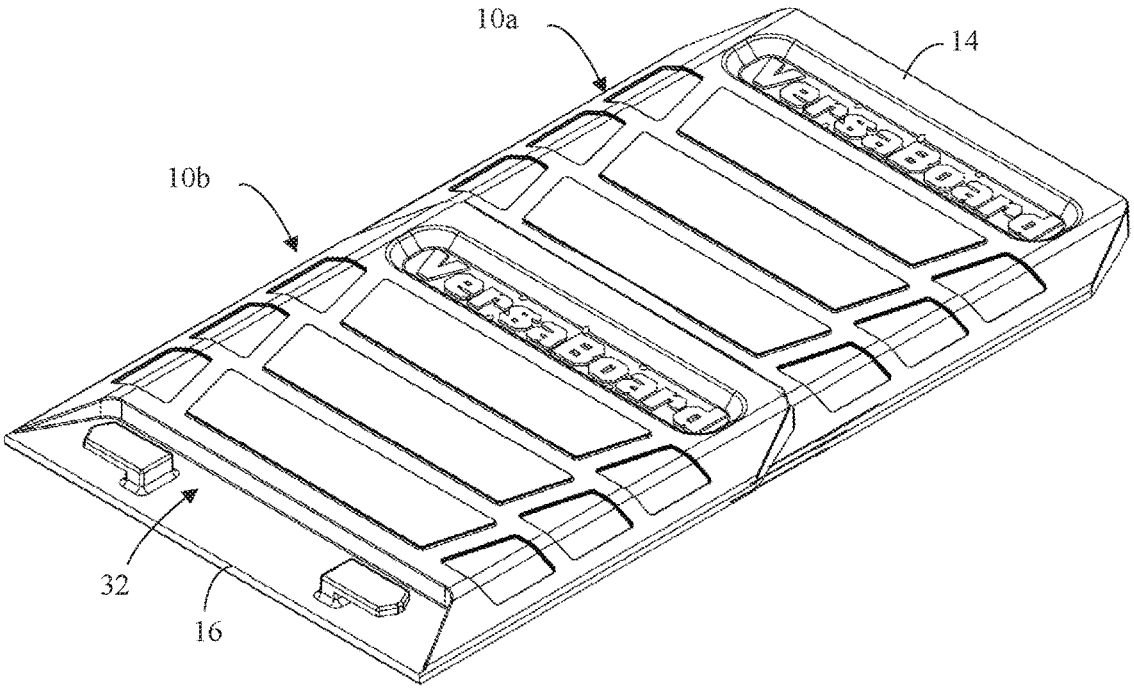
FIG. 18 is a perspective view of an embodiment of the present invention showing two longitudinally adjacent planks engaged to each other.

Referring now to FIGS. 8-9, an embodiment of plank 10 includes one or more fastener attachment points 26 proximate proximal end 14. Attachment points 26 are depicted as apertures sized to receive attachment components (not shown) that temporarily attach plank 10 to an existing blocking sled. However, attachment points 26 may be recesses or housings designed to hold various attachment components.

An embodiment of the present invention may use attachment components known to a person of ordinary skill in the art that automatically disconnect when a certain force threshold is met. For example, one such component may be a suction cup adapted to engage a portion of sled 50. Another example is a flexible J-shaped member having a predetermined elastic modulus, such that the J-shape flexes into a generally linear shape when subject to tension forces exceeding a predetermined threshold force. At one end, the J-shaped member is secured to attachment points 26 of plank 10. At the curved end, the J-shaped member is hooked around a support structure on sled 50. When sled 50 is pushed the resulting tension force does not exceed the predetermined threshold force to cause the curved end to elastically deform. However, an athlete accidentally stepping on plank 10 while pushing sled 50 will result in the J-shaped member experiencing a tension force beyond the predetermined threshold force causing the attachment member to elastically deform into a more linear shape and disconnect from sled 50. It is contemplated that other elastic attachment components can be used with differing shapes so long as the attachment components can attach to sled 50 when in a position of repose and disconnect from sled 50 when subject to a tension force beyond the predetermined threshold force. In an embodiment, the elastic attachment component may be secured to sled 50 with the deformable/detachable end secured to plank 10 at attachment points 26.

An embodiment may also use spring-type attachment components, such as bungee cords, springs, and any other type of elastic biasing device, that do not disconnect from sled 50 when the athlete steps on plank 10. Instead, these spring-type attachment components are secured to attachment points 26 and to sled 50, and they elastically deform about their length when the athlete steps on plank 10. The athlete will still receive a tactile response from an incorrect step, but plank 10 will remain connected to sled 50. The tactile response will mimic the athlete slipping, but will allow the athlete to continue pushing sled 50, without stepping on plank 10, until the drill ceases.

An embodiment of plank 10 is adjustable in length and/or width to easily transition between athletes of different sizes. For example, an embodiment includes a plurality of fasteners or attachment components (not shown) located on one or both of the lateral sides 18 of plank 10. These components allow for the temporary attachment of secondary lateral plank(s) to lateral sides 18 of plank 10 to increase the overall width of the device. In an embodiment, one or more of the secondary lateral planks are attached to plank 10 via hinges disposed along the lateral edge of plank 10. These hinges engage both plank 10 and the secondary lateral planks and are preferably recessed between the top and bottom surface of the planks to prevent the hinges from contacting the ground or an athlete's footwear when the athlete accidentally steps on the planks.

An embodiment includes several laterally connected planks adapted to fold onto one another and unfold in a lateral direction to significantly alter the width of the training device. An embodiment may also include one or more pairs of secondary lateral planks nested within each of the lateral edges of plank 10. The nested secondary planks can telescope out of the lateral sides of plank 10 to increase the width of the training device.

Likewise, plank 10 may include a plurality of fasteners or attachment components located on, or proximate to, one or both proximal and distal ends 14, 16 of plank 10 such that one or more secondary planks can be temporarily attached to primary plank 10 to increase the overall length of the device. Exemplary embodiments are depicted in FIGS. 10-21.

Referring to FIGS. 10-18, an embodiment includes plank interconnectors 28 disposed proximate to distal end 16 of plank 10 and interconnector receipts 30 disposed proximate to proximal end 14. Interconnector receipts 30 are disposed within bottom surface 22 and are sized and shaped to receive plank interconnectors 28 from another plank 10, such as plank 10*b* shown in FIGS. 16-18. The depicted embodiment of plank interconnectors 28 are in the form of an L-shaped hook. The free ends of plank interconnectors 28 extend outwardly in a lateral direction. Likewise, interconnector receipts are generally rectangular in shape and extend in a lateral direction to receive plank interconnectors 28.

Interconnector receipts 30 are disposed on either lateral side of magnet 24 to avoid interfering with magnet 24 when used to magnetically connect plank 10 to sled 50. However, an embodiment may include one or more interconnector receipts that are arranged at various locations near proximal end 14 to receive plank interconnectors 28.

In addition, proximal end 14 includes a generally trapezoidal shape and distal end 16 includes nesting region 32, which is inversely shaped to receive a proximal end of a secondary plank 10*b*. As a result, proximal end 14 of plank 10*b* can nest in distal end 16 of plank 10*a* such that planks 10*a* and 10*b* move as if they are a single plank.

An embodiment may include other forms of plank interconnectors 28 and interconnector receipts 30 known to a person of ordinary skill in the art. For example, an embodiment may include secondary magnet(s) located at distal end 16 of plank 10 that are configured to magnetically engage magnets 24 secured to a secondary longitudinally aligned plank. Another embodiment, as depicted in FIGS. 19-21, includes interconnector receipts 30 in the form of fastener apertures 34 disposed through top and bottom surfaces 22, 24 near distal end 16 and near proximal end 14.

In the embodiment depicted in FIGS. 19-21, plank interconnectors 28 are in the form of fasteners. An exemplary fastener 38 is depicted in FIG. 20. Fastener 38 includes threaded bolt 40, which engages bolt receiver 42. Bolt receiver 42 includes a threaded receipt 44 configured to threadedly receive bolt 40. It is contemplated that different fasteners can be used to secure a first plank to a second plank, so long as the fasteners can pass through fastener apertures 34. In an embodiment, the fasteners are recessed below top and bottom surfaces 20, 22 to reduce unwanted friction with the ground and unwanted contact with the athlete.

In an embodiment, one or more of the secondary longitudinal planks are attached to plank 10 via hinges disposed at the distal end of plank 10 and at the distal ends of the secondary longitudinal planks. These hinges are preferably recessed between the top and bottom surface of the planks to prevent the hinges from contacting the ground or an athlete's footwear when the athlete accidentally steps on the planks. An embodiment includes several longitudinally connected planks adapted to fold onto one another and unfold in a longitudinal direction to significantly alter the length of the training device. An embodiment may include one or more pairs of secondary longitudinal planks nested within the distal end of plank 10. The nested secondary planks can telescope out of the distal end of plank 10 to increase the length of the training device.

Figure 22:
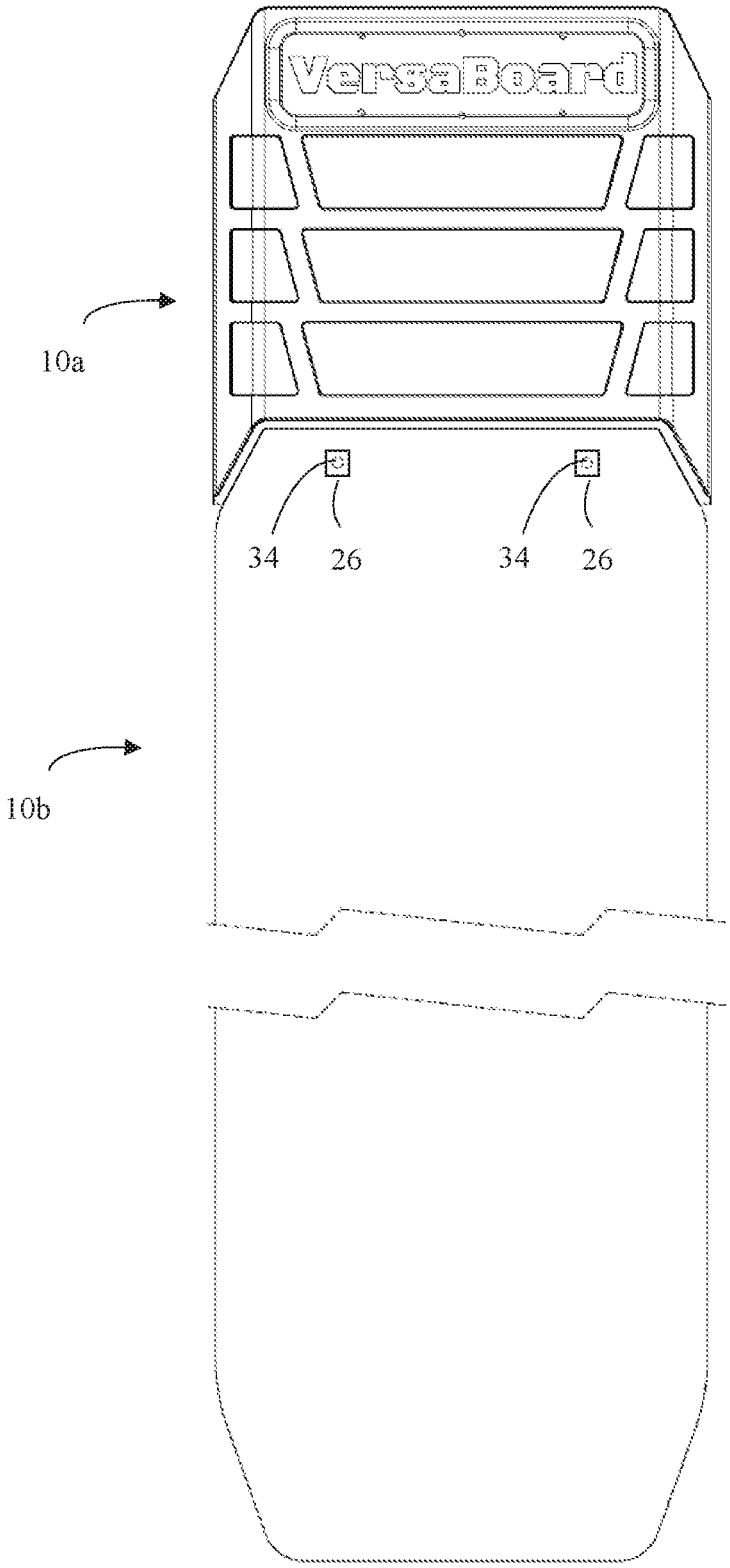
FIG. 22 is a top view of an embodiment of the present invention.

FIG. 22 provides another variation of a multi-plank embodiment. This embodiment is similar to other embodiments employing a plurality of interconnected planks, but includes second plank 10*b* being longer and less complex than the first plank 10*a*. The exemplary depicted embodiment shows plank 10*a* form FIGS. 19-21 and plank 10*b* from FIGS. 8-9. Attachment points 26 from plank 10*b* are in the form of apertures that align with apertures 34 in plank 10*a*. A fastener, similar to the one disclosed in FIG. 21 can be employed to secure plank 10*a* to plank 10*b*. This embodiment allows for a more complex plank 10*a* to act as a universal head plank that engages the sled, while a less complex tail plank 10*b* (which can be produced in various sizes) can be attached to the universal head plank 10*a*. Moreover, the tail plank 10*b* can be more readily replaced when worn as it is a less expensive and less complex plank to produce.

In an embodiment, plank 10 is preferably made of a lightweight and flexible material (in the range of 10-25 lbs). An embodiment includes a friction reducing material and/or substance applied to bottom surface 22 of plank 10 to allow for the use of a weaker and thus less expensive magnet 24.

In an embodiment, plank 10 is also made of a resilient material capable of withstanding punctures from an athlete's cleats when the athlete steps on plank 10. Preferably, the material can withstand punctures from cleats worn by athletes weighing up to 400 lbs.

An embodiment of plank 10 further includes a magnet or magnetically-responsive material secured to, or within, plank 10 at distal end 16. This magnet/magnetically-responsive material allows plank 10 to be rolled up and secured in the rolled position through the magnetic forces between magnet 24 and the secondary magnet disposed in distal end 16, which allows plank 10 to be more easily carried, stored, and shipped.

An embodiment further includes an additional magnet/magnetically-responsive material secured to, or within, plank 10 at a location along the length of plank 10. In an embodiment, that location is a midpoint of plank 10. A secondary plank can then be attached to a first plank in a perpendicular, or generally T-shaped, orientation, which allows for more complex training.

An embodiment also includes an advertising section 46 which includes pins 48 for securing an advertisement (depicted as "VersaBoard") to plank 10. Pins 48 allow the advertisement to vary from plank to plank and offer various businesses the opportunity to advertise to professional athletes.

The present invention also includes a method of training athletes to push a sled or block an opponent with a proper stance width. The method includes determining a proper length and width of a plank to be used, and attaching a plank having a proper width and length to a sled via an attachment component. The proper length and width of the plank is determined based on the height of the athlete. A single plank of proper size is selected or a plurality of planks are interconnected to create a training plank of the proper size. The attachment component is then used to attach the plank to the sled. Preferably the plank is temporarily attached to the sled. The athlete then practices pushing or blocking the sled with a stance that straddles the plank. The plank provides a tactile and visual indication of an improperly narrow stance when an athlete steps on the plank while pushing the sled and the plank resultingly disconnects from the sled.

The method of the present invention may be achieved by using one or more of the embodiments of the various components, e.g. plank and attachment components, described herein.

The present invention is applicable to any training sleds for any athletes. The description above should not be construed to mean that the device is only applicable to football players or football blocking sleds. Rather, the present invention can be used with any sport-neutral training sled to force athletes to drive the sled with a wider stance which can have benefits beyond simply learning to block.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A stance training system, comprising:

a training sled having a sled base and a blocking pad;

a plank assembly comprising a head plank and a tail plank, wherein each of the head and tail planks includes:

a length extending between a proximal end and a distal end;

a width extending between a first lateral side and a second lateral side, wherein the width of each plank being between six and twenty-four inches;

the length of the head plank being shorter than the length of the tail plank;

the distal end of the head plank having a nesting region that is shaped to receive the proximal end of the tail plank;

a plank attachment component configured to longitudinally connect the tail plank to the head plank when the tail plank is nested within the nesting region of the head plank, such that the head and tail planks act as a single plank;

the head plank having a magnetic attachment member, wherein the magnetic attachment member is configured to detach from the training sled when subject to a force exceeding a predetermined threshold force; and the plank assembly thereby providing a tactile indication of an improperly narrow stance when an athlete steps on the plank assembly while pushing the training sled causing the plank assembly to detach from the training sled.

2. The stance training system of claim 1, wherein the magnetic attachment member is secured between a top surface and a bottom surface of the head plank.

3. The stance training system of claim 1, further including a magnet housing proximate the proximal end of the head plank, the magnet housing configured to open and close for securing the magnetic attachment member within the magnet housing.

4. The stance training system of claim 1, further including a magnet recess proximate the proximal end of the head plank, the magnet recess configured to house at least a portion of the magnetic attachment member residing internally with respect to a top surface or a bottom surface of the head plank.

5. The stance training system of claim 1, further including a second magnet secured to the tail plank proximate the distal end of the tail plank.

6. The stance training system of claim 1, wherein the plank assembly weighs between ten and twenty-fixe pounds.

7. The stance training system of claim 1, wherein at least the proximal end of the head plank is comprised of a flexible material thereby enabling the proximal end to be flexed when the head plank is connected to the training sled.

8. The stance training system of claim 1, further including the magnetic attachment member having a magnetic strength equivalent to a force between ninety-five and two hundred and twenty-five pounds.

9. A method for training an athlete to push an object with a proper stance width comprising:

providing a training sled with a sled base and a blocking pad;

providing a plank assembly, wherein the plank assembly includes:

a head plank and a tail plank, each of the head and tail planks includes:

a length extending between a proximal end and a distal end;

a width extending between a first lateral side and a second lateral side, wherein the width of each plank is between six and twenty-four inches;

a distal end of the head plank having a nesting region that is shaped to receive a proximal end of the tail plank;

a plank attachment component configured to longitudinally connect the tail plank to the head plank when the tail plank is nested within the nesting region of the head plank, such that the head and tail planks act as a single plank;

the head plank having a magnetic attachment member, wherein the magnetic attachment member is configured to detach from the training sled when subject to a force exceeding a predetermined threshold force;

the length of the head plank being shorter than the length of the tail plank;

attaching the head plank to the training sled via the magnetic attachment member;

attaching the tail plank to the head plank via the plank attachment component;

whereby the plank assembly provides a visual and tactile indication of an improperly narrow stance when an athlete steps on the plank assembly while pushing the training sled causing the plank assembly to detach from the training sled.

10. The method of claim 9, wherein the magnetic attachment member is secured between a top surface and a bottom surface of the head plank.

11. The method of claim 9, wherein the head plank further includes a magnet housing proximate the proximal end of the head plank, the magnet housing configured to open and close for securing the magnetic attachment member within the magnet housing.

12. The method of claim 9, wherein the head plank further including a magnet recess proximate the proximal end of the head plank, the magnet recess configured to house at least a portion of the magnetic attachment member residing internally with respect to a top surface or a bottom surface of the head plank.

13. The method of claim 9, wherein the plank assembly weighs between ten and twenty-five pounds.

14. The method of claim 9, wherein at least the proximal end of the head plank is comprised of a flexible material thereby enabling the proximal end to be flexed when the head plank is connected to the training sled.

* * * * *